United States Patent [19]

Fujiwhara et al.

[11] 4,175,966

[45] Nov. 27, 1979

[54] LIGHT-SENSITIVE BLACK-WHITE SILVER HALIDE PHOTOGRAPHIC MATERIAL FOR FORMING A HIGH-CONTRAST SILVER IMAGE AND METHOD OF TREATING THEREOF

[75] Inventors: Mitsuto Fujiwhara; Syunji Matsuo; Toyoaki Masukawa; Yutaka Kaneko; Mikio Kawasaki, all of Hino, Japan

[73] Assignee: Konishiroku Photo Industry Co., Ltd., Tokyo, Japan

[21] Appl. No.: 948,539

[22] Filed: Oct. 4, 1978

Related U.S. Application Data

[63] Continuation of Ser. No. 710,385, Aug. 2, 1976, abandoned.

[30] Foreign Application Priority Data

Aug. 2, 1975 [JP] Japan ..... 50-94295

[51] Int. Cl.[2] ..... G03C 5/30; G03C 1/06; G03C 1/28

[52] U.S. Cl. ..... 430/438; 430/440; 430/566; 430/564; 430/508

[58] Field of Search ..... 96/95, 109, 107, 66, 96/66.3, 66.4, 66.5, 114.5

[56] References Cited

U.S. PATENT DOCUMENTS

| | | | |
|---|---|---|---|
| 3,061,436 | 10/1962 | Himmelmann | 96/111 |
| 3,071,465 | 1/1963 | Dersch et al. | 96/66 |
| 3,396,022 | 8/1968 | Dersch et al. | 96/66.5 |
| 3,420,664 | 1/1969 | Dersch et al. | 96/66.5 |
| 3,420,667 | 1/1969 | Copeland | 96/107 |
| 3,503,741 | 3/1970 | Wilson | 96/20 |
| 3,597,213 | 8/1971 | Dersch et al. | 96/109 |
| 3,765,891 | 10/1973 | Travis | 96/66.3 |
| 3,847,619 | 11/1974 | Bissonette et al. | 96/112 |
| 3,891,442 | 6/1975 | Beavers | 96/95 |
| 3,909,268 | 9/1975 | Baldassari et al. | 96/109 |
| 3,915,713 | 10/1975 | Shiba et al. | 96/95 |
| 3,957,491 | 5/1976 | Ohi | 96/107 |
| 3,980,479 | 9/1976 | Fields | 96/95 |

FOREIGN PATENT DOCUMENTS

| | | |
|---|---|---|
| 1446226 | 4/1968 | United Kingdom . |
| 1214982 | 8/1976 | United Kingdom . |

OTHER PUBLICATIONS

PPP No. 49-5333, Derwent Abstract.

*Primary Examiner*—Mary F. Kelley
*Attorney, Agent, or Firm*—Frishauf, Holtz, Goodman & Woodward

[57] ABSTRACT

A light-sensitive silver halide photographic material containing a substantially non-diffusible compound having oxidation power on a hydroquinone developing agent in a hydrophilic colloidal layer is processed, after light exposure, with a developer containing the said hydroquinone developing agent to form a high-contrast silver image.

5 Claims, No Drawings

LIGHT-SENSITIVE BLACK-WHITE SILVER HALIDE PHOTOGRAPHIC MATERIAL FOR FORMING A HIGH-CONTRAST SILVER IMAGE AND METHOD OF TREATING THEREOF

This is a continuation, of application Ser. No. 710,385, filed Aug. 2, 1976, now abandoned.

This invention relates to a light-sensitive silver halide photographic material for forming a high-contrast silver image and a method of processing thereof. Particularly, this invention relates to a light-sensitive black-and-white silver halide photographic material for forming a high-contrast silver image with high sharpness and high resolving power.

More particularly, this invention relates to a light-sensitive black-white silver halide photographic material which is advantageously applicable to silver halide light-sensitive materials, for photolithography, X-ray photography for industrial use or for reproduction, having high-contrast and to method of processing such sensitive material to form high-contrast silver images.

There has been known a method of forming high-contrast photographic images using a known light-sensitive silver halide material. For example, there has been known a method of forming a high-contrast image, for example, a line image or a halftone image for photomechanical process by using a light-sensitive material comprising a silver chloro-bromide emulsion which is of fine cubic silver chloro-bromide grains having a narrow size distribution and a high content of silver chloride (at least over 50 moles percents of silver chloride), with an alkaline solution containing hydroquinone in a relatively small concentration of sulfurous ion. Such a light-sensitive silver halide material is known as a so-called lith type light-sensitive material.

In a process of preparing a halftone image in photolithography, there is generally involved a process of converting a continuous density change of a manuscript into halftone dots of which area changes in proportion to the density of the manuscript. For the sake of this, a halftone image can be formed by a photographing manuscript using the said lith type light-sensitive material, exposing said material through a cross screen or a contact screen and developing it. But the light-sensitive silver halide material in itself, even if a light-sensitive material having extremely high-contrast were used, has a capacity of reproducing an intermediate density in addition to the maximum and minimum density required to form a halftone dot image.

This intermediate density part results in making a density slope apart, that is, fringe which is unfavorable to a photolithographic process and deteriorating dot qualities of the halftone image.

For avoiding such defects, such developing solution as is called an infectious developer has been used, although it has constituted a bottleneck in the field of photolithographic arts because of its poor preservability due to low sulfite concentration.

A lot of research has been made for improving this poor preservability, but there has been known neither a process for forming images having excellent dot qualities without using the infectious developer nor a developer having excellent preservability and stability comparable to a metolhydroquinone developer or phenidone-hydroquinone developer which has been used for reproducing continuous tone images.

A silver halide photographic material for industrial X-ray photography is known as one of high-contrast photographic material, but it has been known that the contrast of a developed X-ray-exposed-image comes out extremely low compared with a light-exposed-image.

Therefore, photo-sensitive materials for industrial X-ray photography have been expected to have much higher contrast from their intended object.

But every trial for enhancing contrast had resulted in desensitization of a light-sensitive silver halide photographic material and so there has been a strong need for developing a light-sensitive material having high sensitivity and high-contrast for this end.

Therefore, one object of this invention is to provide a novel black-white light-sensitive silver halide photographic material for forming a high-contrast silver image.

Another object is to provide a novel method for forming high-contrast silver images.

A further other object is to provide a novel lith type light-sensitive silver halide material suitable for obtaining a line or a halftone image. A still further other object is to provide a novel method for processing a light-sensitive silver halide materials for obtaining high-contrast silver images.

We have carried out research for accomplishing the above object and have found that the object could be obtained by exposing a black-and-white light-sensitive silver halide photographic material which comprises a support and at least one hydrophilic colloid layer coated thereon which contains silver halide grains and one or more of substantially non-diffusible compounds having oxidation power on a hydroquinone developing agent and then developing said material with a developer containing hydroquinone developing agent.

In this invention, "a compound having oxidation power on a hydroquinone developing agent", as is described in detail in Reference-1, means such a compound as has a positive surface oxidation-reduction potential of a gelatin layer which contains the said compound in a buffer solution containing hydroquinone against a surface oxidation-reduction potential of a gelatin layer without the compound in the said buffer solution.

Also in this invention, "a substantially non-diffusible compound" means a compound that can not be diffused out in a processing solution from the light-sensitive photographic material during development and, in concrete terms, a compound such as does not diffuse from the light-sensitive photographic material into an aqueous solution in a concentration of over several percentage, preferably over 2%, in case a gelatin layer containing the said compound is immersed in an aqueous solution having the same ionic strength and the same hydrogen ion concentration as the developer described in Reference-2 at 20°–40° C. for 10 minutes.

Typical examples of substantially non-diffusible compounds having oxidation power on the said hydroquinone type developing agents according to this invention will be exemplified as follows, but they are not to be construed in a limiting manner.

1. N-chloroarylsulfonamide sodium type compounds: for example,
   N-chloro-p-dodecylbenzenesulfonamide sodium,
   N-chloro-p-nonylbenzenesulfonamide sodium, etc.
2. Quinone type compounds: for example,
   2-dodecylbenzoquinone, 2,5-dioctylbenzoquinone,
2-dodecyl-5-methylbenzoquinone, etc.

3. 1 Quaternary salts

The compounds belonging to this group can be divided broadly into two categories: that is, compounds of which the cation part containing the quaternary nitrogen is itself non-diffusible (hereinafter, referred to as intrinsic non-diffusible compounds) and compounds of which the cation part is diffusible but is made non-diffusible by reacting with a non-diffusible anion as an ion pair in a hydrophilic colloidal matrix such as gelatin (hereinafter, referred to as non-diffusible anionic compounds). It is a matter of course that the intrinsic non-diffusible compounds of which the anion part are non-diffusible can also be applied advantageously in this invention.

(a) Intrinsic non-diffusible compounds:
2-(benzothiazol-2-yl)-3-phenyl-5-dodecyl-2H-tetrazolium bromide,
2,3-diphenyl-5-(4-t-octyloxyphenyl)-2H-tetrazolium chloride, etc.

(b) Non-diffusible anionic compounds: as cation parts, for example
2,3,5-triphenyl-2H-tetrazolium,
2,3,5-tri(p-carboxyethylphenyl)-2H-tetrazolium,
2-(benzothiazol-2-yl)-3-phenyl-5-(o-chlorophenyl)-2H-tetrazolium,
2,3-diphenyl-2H-tetrazolium,
2,3-diphenyl-5-methyl-2H-tetrazolium,
3-(p-hydroxyphenyl)-5-methyl-2-phenyl-2H-tetrazolium,
2,3-diphenyl-5-ethyl-2H-tetrazolium,
2,3-diphenyl-5-n-hexyl-2H-tetrazolium,
2,3-diphenyl-5-dodecyl-2H-tetrazolium diethylhexylsuccinatesulfonate salt
5-cyano-2,3-diphenyl-2H-tetrazolium,
2-(benzothiazol-2-yl)-5-phenyl-3-(4-tolyl)-2H-tetrazolium,
2-(benzothiazol-2-yl)-5-(4-chlorophenyl)-3-(4-nitrophenyl)-2H-tetrazolium,
5-ethoxycarbonyl-2,3-di(3-nitrophenyl)-2H-tetrazolium,
5-acetyl-2,3-di(p-ethoxyphenyl)-2H-tetrazolium,
2,5-diphenyl-3-(p-tolyl)-2H-tetrazolium,
2,5-diphenyl-3-(p-iodophenyl)-2H-tetrazolium,
2,3-diphenyl-5-(p-diphenyl)-2H-tetrazolium,
5-(p-bromophenyl)-2-phenyl-3-(2,4,6-trichlorophenyl)-2H-tetrazolium,
3-(p-hydroxyphenyl)-5-(p-nitrophenyl)-2-phenyl-2H-tetrazolium,
4-dimethoxyphenyl)-3-(2-ethoxyphenyl)-2-(4-methoxyphenyl)-2H-tetrazolium,
5-(4-cyanophenyl)-2,3-diphenyl-2H-tetrazolium,
3-(p-acetamidophenyl)-2,5-diphenyl-2H-tetrazolium,
5-acetyl-2,3-diphenyl-2H-tetrazolium,
5-(fur-2-yl)-2,3-diphenyl-2H-tetrazolium,
5-(thien-2-yl)-2,3-diphenyl-2H-tetrazolium,
2,3-diphenyl-5-(pyrid-4-yl)-2H-tetrazolium,
2,3-diphenyl-5-(quinol-2-yl)-2H-tetrazolium,
2,3-diphenyl-5-(benzoxazol-2-yl)-2H-tetrazolium,
2,3-diphenyl-5-nitro-2H-tetrazolium,
2,2',3,3'-tetraphenyl-5,5'-1,4-butylene-di-(2H-tetrazolium)
2,2',3,3'-tetraphenyl-5,5'-p-phenylene-di-(2H-tetrazolium)
2-(4,5-dimethylthiazol-2-yl)-3,5-diphenyl-2H-tetrazolium,
3,5-diphenyl-2-(triazin-2-yl)-2H-tetrazolium,
2-(benzothiazol-2-yl)-3-(4-methoxyphenyl)-5-phenyl-2H-tetrazolium, etc.

or cation parts of tetrazolium salts such as are disclosed in Chemical Review, 55 355–483 (1955) and further the following compounds:
1-methyl-2-phenyl-2H-1,2,3-triazolium,
1-n-propyl-2-phenyl-2H-1,2,3-triazolium,
2-(4-methoxyphenyl)-3-phenyl-2H-naphtho-[1,2-d]-1,2,3-triazolium,
3,5-(9,10-anthraquinolyl)-bis-{2-[3-phenyl]-2H-naphtho-[1,2-d]-1,2,3-triazolium},
2,3-di(4-methoxyphenyl)-5-nitro-2H-naphtho[1,2-d]-1,2,3-triazolium,
1,1'-dimethyl-4,4'-bipyridinium,
1,1'-diethyl-4,4'-bipyridinium,
1,1'-dibenzyl-4,4'-bipyridinium,
on the other hand, as anion parts: for example, higher alkylbenzenesulfonic acid anions such as p-dodecylbenzenesulfonic acid anion,
higher alkyl sulfate anions such as lauryl sulfate anion,
dialkyl sulfosuccinate anions such as di-2-ethylhexyl sulfosuccinate anion,
polyetheralcohol sulfate anions such as ethylpolyethenoxy sulfate anion,
higher fatty acid anions such as stearic acid anion,
polyacrylic acid anions such as are polymers having acid radicals By making an appropriate selection of anion and cation part, the substantially non-diffusible compounds having oxidation power on hydroquinone developing agents according to this invention can be prepared. As will be illustrated in detail in examples, the compounds thus obtained of this invention such as 2,3,5-triphenyl-2H-tetrazolium dioctylsuccinate sulfonate salt can be incorporated into a gelatin matrix either by dissolving the respective soluble salt in gelatin and then mixing them or by synthesizing the pure crystalline oxidant, dissolving it in a suitable solvent such as dimethylsulfoxide, and then dispersing it into a gelatin matrix. When a uniform dispersion is difficult to form, it is useful to use suitable homozenizers such as ultrasonic or colloid mill homozenizers.

4. Peracids
stearic peracid, palmitic peracid, etc.

5. Other organic oxidized compounds
pyridine-N-oxide polymer, etc.

6. Metal complex cations
hexammine cobalt (III), triethylenediamine cobalt (III), bis(diethanolamine) cobalt (III), hexammine chromium (III), bis(dipropanolamine) chromium (III), bis(ethylenediamine) trimethylenediamine cobalt (III), etc.

The compounds of this group can be used like quaternary salts by making salts of these cations with anions of non-diffusible anionic compounds as described in regard to the above quaternary salts 3(b).

7. N-haloimides
N-bromosuccinimide,
N-bromooctadecylphthalylimide, etc.

8. Other non-diffusible inorganic oxidants: tetraphenylphosphonium bichromate, tetraphenylphosphonium permanganate, tetraphenylarsonium perchromate etc.

According to one preferred embodiment of this invention, the substantially non-diffusible compounds having oxidation power over hydroquinone developing agents according to this invention can be incorporated into a silver halide emulsion layer. In another preferred embodiment, they can be incorporated into a layer directly or through an inter layer adjacent to the silver halide emulsion layer.

In general, direct addition of oxidants to the silver halide layer, for example, the addition of tetrazolium salts to the silver halide emulsions results in disadvantages such as remarkable desensitization. For this, the oxidants of this invention are preferred to be preserved without direct contact with silver halides in the light-sensitive photographic material. According to another embodiment of this invention, the above compounds of this invention are added into silver halide emulsion layers in the form of an oil-protect dispersion. The remarkable desensitization due to added oxidants can be considerably prohibited by these means.

The compounds according to this invention are stable in coating solutions and are substantially non-diffusible during a developing process.

According to one of the preferred examples, a layer containing an ion pair of tetrazolium ion and diethyl hexyl succinate sulfonic acid (hereinafter, referred to as DES) anion is made adjacent to a silver halide emulsion layer, the silver image obtained has high sensitivity compared with the case of using diffusible tetrazolium chloride, and shows high-contrast. According to the result of analysis, elution of the ion pair of tetrazolium and DES from the light-sensitive silver halide photographic material to the processing solution is less than several percent, thus showing that the compound of this invention is substantially non-diffusible in the material. In case a layer containing an ion pair of $[Co(III)(NH_3)_6]^{3+}$ and DES anion—another embodiment of this invention—is made adjacent to a silver halide emulsion layer, high speed and high contrast image can be obtained compared with the case of using diffusible $[Co(III)(NH_3)_6]Cl_3$. It is clear as in Table-6 that desensitization due to addition of Co(III) ion complex of the present invention is remarkably low and the compound shows substantial non-diffusibility during a developing process.

The compounds according to this invention are preferably used in a range of 0.0001 to 10 moles, preferably over 0.001 mole per one mole of silver of the light-sensitive silver halide photographic material.

Some prior for the improvement of various kinds photographic characteristics by incorporating a oxidant or compound having oxidizing power into a silver halide light-sensitive material has been known and such art are disclosed in such Patent Publications of U.S. Pat. Nos. 3,503,741, 3,909,268, OLS 2,360,327 (where OLS means Offenlegungsschrift in West German), Provisional Patent Publication (hereinafter, referred to as PPP) No. Sho 49-5333/1974, etc. But the present invention is different in terms of concrete settlement and action and effect from these prior arts. Therefore, the present invention is based on a different technical idea from them. For example, the invention disclosed in U.S. Pat. No. 3,503,741 concerns a silver-dye-bleach process and a process of improving a decrease in effective sensitivity which is a defect in the silver-dye-bleach process. According to the disclosure of the specification, a colorless tetrazolium salt dye precursor contained in a silver halide light-sensitive material is developed to form a dye, and thereafter followed by a silver-dye-bleach process. The invention disclosed therein relates to a process of obtaining a color image. Therefore, the tetrazolium salt is used as a color image forming substance and the above invention is essentially different in the object, constitution and effect from this invention in that a reversal dye color image is finally obtained. Also in U.S. Pat. No. 3,909,268 there is disclosed a silver halide light-sensitive material containing a tetrazolium-o-oxybetaine compound, but the compounds are all diffusible compounds. This point is different from this invention using non-diffusible compounds. Therefore, according to the process disclosed therein, the same object as that in this invention cannot be achieved and deterioration of photographic characteristics such as decrease in a maximum density occurs. It is less to obtain an excellent halftone image with good dot qualities even when the photographic material is developed with a usual developing solution as usual hydroquinone-metol or hydroquinone-phenidone containing solutions. There is disclosed in PPP No. Sho 49-5333 the fact that sensitization can be achieved by treating a lith type light-sensitive material with a solution containing an oxidant before development. But the oxidants used in the above said invention are all diffusible compounds and so are different from those used in this invention. Further, in OLS 2,360,327 there is disclosed a light-sensitive material element containing metal compounds such as cobalt or chromium and ammonia, trimethylenediamine or diethanolamine in a definite composition range of a light-sensitive silver chloro-iodo-bromide material. This light-sensitive material element shows better characteristics by containing further azaindene and gives high-contrast without using harmful cadmium salts. The said metal complex compound may contain an ion pair such as chloride, bromide, and perchlorate as anion. But these compounds are apt to diffuse compared with those in this invention and in case where these compounds are incorporated into the silver halide light-sensitive materials, a remarkably high-contrast silver image can not be expected without accompanying desensitization as in this invention and particularly an improving effect in dot qualities can not be completely expected. On the other hand, bad effects such as desensitization during a storage period and any effective means to prevent these defects has not been found yet. So, this method can only compensate the shortage of contrast on known lith type development and has some problems for practical use because of the above defects.

On the other hand, we have found that, in a process containing non-diffusible oxidants according to this invention, improvement in contrast and especially in halftone dot qualities is accomplished by using not only a usual lith type developing solution which contains only hydroquinone as a developing agent but also in the case of MQ or PQ developer, in which a lith type development is completely unexpected. In BP 1,214,982 there is disclosed the fact that cobalt salts can be used in a extremely low concentration as stabilizers and antifogants. But in case the cobalt salt is added in a high concentration to a silver halide photographic emulsion, and especially when a watersoluble cobalt salt is used, a remarkable desensitization occurs and it is also impossible to accomplish the object of this invention. Recently, in U.S. Pat. No. 3,765,891, there is disclosed a process of incorporating a cobalt (III) ion complex in a high concentration to a photographic element. Another process is also disclosed in OLS 2,357,695, FP 2,207,296 and U.S. Pat. No. 3,847,619. But in each process, remarkable desensitization results and the improvement of contrast and especially the improvement of the dot qualities can not be expected. And most of these examples concern light-sensitive color photographic materials. On the contrary, in case the light-sensitive black-white silver halide photographic material containing an anion pair of a substantially non-diffusible Co(III) compound according to this invention is treated with a developer containing a hydroquinone developing agent, without any remarkable desensitization, an unexpected and extremely high-contrast silver image can be obtained. And a still more astonishing thing is that excellent dot silver images can be obtained without using a lith type developer.

In a light-sensitive material containing a cobalt(III) ion complex which is disclosed in U.S. Pat. No. 3,765,891, OLS 2,357,695, FP 2,207,296 or U.S. Pat. No. 3,847,619, the complex compound, as is disclosed in the specifications, is relatively non-diffusible in a hydrophilic colloidal layer, but is still diffusible in a developing solution in comparison with the compounds used in the present invention. This compound acts in the same way in a developer containing a hydroquinone developing agent and releases the Co(III) complex ion and diffuses, so that it causes remarkable desensitization compared with those compounds of this invention and produces only low-contrast silver images. In this way, in all such prior art which is applicable to a light-sensitive silver halide photographic material containing a compound having oxidizing power, their object or concrete constitution is different from that of this invention and a process of obtaining remarkable high-contrast effect and excellent dot images without using the lith type development has not been found before this invention.

Light-sensitive silver halide photographic materials which are used for this invention can be any of known silver halides such as silver bromide, silver chlorobromide, silver iodobromide, silver chloro-iodo-bromide and silver chloride and so forth, all of which are used in usual silver halides photographic emulsions. These silver halide may be of rough or fine grains and can be prepared by any known method such as is disclosed in U.S. Pat. Nos. 2,592,250, 3,276,877, 3,317,322, 2,222,264, 3,320,069, 3,206,313 or J. Phot. Sci., 12 242–251 (1964). Further, the silver halides prepared by different methods may be used in mixing them. The grain size distribution of the silver halide emulsion used in the present invention can be optional. But, in general, favorable results will be obtained when an emulsion having narrow grain size distribution is employed. In the silver halide emulsions according to this invention, soluble salts are preferred to be removed but may be used without removing them.

The silver halide emulsions according to this invention may be sensitized with one or more of various chemical sensitizers such as active gelatin, sulfur sensitizers, e.g. sodium thiosulfate, allylthiocarbamide, thiourea and allylisocyanate, selenium sensitizers, e.g. N,N-dimethylselenourea and selenourea, reduction sensitizers, e.g. triethylenetetramine and stannic chloride and noble metal sensitizers, e.g. potassium chloroaurite, potassium aurithiocyanate, potassium chloroaurate, 2-aurosulfobenzothiazole methyl chloride, ammonium chloropalladate, potassium chloroplatinate and sodium chloropalladite. In the case of using gold sensitizers, ammonium thiocyanate can be used as an aid. Further, the silver halide emulsions may be optically sensitized with one or more of sensitizing dyes so as to have sensitivity in a desired region of sensitive wave length. Various kinds of sensitizing dyes can be used, but the preferred sensitizing dyes are such as cyanines, merocyanines, three or four nucleus merocyanines, three or four nucleus cyanines, styriles, holopolarcyanines, hemicyanines, oxonols and hemioxonols. These optical sensitizers may contain, as heterocyclic ring nuclei at a part of them, nuclei such as basic radicals, e.g. thiazoline and thiazole, thiocyanine, thiohydantoine, oxazolidinedione, barbituric acid, thiobarbituric acid and pyrazolone and these nuclei may be substituted with alkyl, hydroxyalkyl, halogen, phenyl, cyano or alkoxy radicals and condensed with aryl or heterocyclic ring. The silver halide emulsions may be stabilized with compounds which are disclosed in U.S. Pat. Nos. 2,444,607, 2,716,062, 3,512,982, OLS 1,189,380, 2,058,626, 2,118,411, PP No. Sho 43-4133/1968, U.S. Pat. No. 3,342,596, Patent Publication (referred to as PP) No. Sho. 47-4417/1972. OLS 2,149,789, PP No. Sho 39-3825/1964, Patent Application (hereinafter, referred to as PA) No. Sho. 45-77072/1970 and preferred compounds are such as 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo(1,5-a)-pyrimidine, 7-hydroxy-s-triazolo(1,5-a)pyrimidine, 5-methyl-6-bromo-7-hydroxy-s-triazolo(1,5-a)pyrimidine, gallic acid esters (e.g. isoamyl gallate, dodecyl gallate, propyl gallate and sodium gallate), mercaptans (e.g. 1-phenyl-5-mercaptotetrazole, 2-mercaptobenzothiazole), benzotriazoles (e.g. 5-bromobenzotriazole, and 4-methylbenzotriazole) and benzoimidazoles (e.g. 6-nitrobenzoimidazole). In the silver halide emulsions according to this invention, latent image stabilizers of amino acid compounds containing sulfur such as are disclosed in OLS 2,217,153 and 2,217,895 and graduation regulators such as cadmium and rhodium salt can be used but sufficient high-contrast light-sensitive materials can be obtained in this invention without using gradation regulators. In order to enhance contrast in silver halide emulsion, a method of using rhodim or cadmium salts are heretofore known and are disclosed in BP 775,197, U.S. Pat. No. 3,488,709 etc. In the case of use of a rhodium salt, its optimum added amount is an extremely small quantity and extremely narrow in its range, so that the products are apt to vary widely and some problems remain unsettled for preparing stable light-sensitive material. On the other hand, in the case of use of cadmium salts, an extremely small amount should be added ecologically because, in the case of film treatment, the cadmium salt should be finally washed off, so they contaminate circumstances. Cadmium salts are known to hinder metaholism and to be harmful to ecological systems. Cadmium can be detected not only in the air but also in body of marine animals. In view of the toxicity of cadmium and a trace of other metals, and in consideration of public health and usual ecological balance, this invention has provided a novel method of obtaining sufficient high-contrast light-sensitive materials without using harmful metals. The hydrophilic colloid most preferably used for this invention is gelatin. But other hydrophilic colloids such as colloidal albumin, agar, gum arabic, alginic acid, hydrolyzed cellulose acetate, acrylamide, imidopolyamide, polyvinyl alcohol, hydrolyzed polyvinyl alcohol acetate, soluble polymers such as are described in BP 523,661, OLS 2,255,711, 2,046,682 and U.S. Pat. No. 3,341,332, gelatin derivatives, phenylcarbamyl gelatins such as are disclosed in U.S. Pat. Nos. 2,614,928 and 2,525,753, acylated gelatin, phthalated gelatin, or graft copolymers of gelatin with a polymerizable monomer having an ethylene radical which are disclosed in U.S. Pat. Nos. 2,548,520 and 2,831,767 e.g. styrene acrylate, ester acrylate, metacrylic acid, ester metacrylate can also be used in this invention. These hydrophilic colloids can be used in layers containing no silver halide such as a halation prohibiting layer, protective layer and inter layer.

In the hydrophilic colloids according to this invention, there can be incorporated, if necessary, any photographic additive in a range such as not to impair the effect of this invention. These include gelatin plasticizer, hardening agent, surface active agent, image stabilizer, ultraviolet absorber, antistaining agent, pH adjuster, antioxidant, antistatic agent, viscosity increasing agent, granularity improving agent, dye, mordant, britening agent, development regulator, matting agent and the like.

Among the said additives, preferred additives are as follows: viscosity increasing agent or plasticizers are such as are disclosed in U.S. Pat. No. 2,960,404, PP No. Sho 43-4939/1968, OLS 1,904,604, PPP No. Sho 48-63715/1973, PP No. Sho 45-15462/1970, Bel. P 762,833, U.S. Pat. No. 3,767,410 and Bel. P 558,143, for example, copolymer of styrene and sodium maleate and dextran sulfate; hardening agents are several hardening agents such as aldehyde type, epoxy type, ethyleneimine type, active halogen type, vinylsulfone type, carbodimide type, mucochloric acid type and acyloyl type compounds; image stabilizers are 6,6-butylidenebis(2-t-butyl-4-methylphenol) and 4,4'-methlenebis(2,6-di-t-butylphenol) and the like. Ultraviolet ray absorbers are such as are described in PP Nos. 48-736, -5496,-41572, -31255/1973, U.S. Pat. Nos. 3,707,375, 3,253,921, BP 1,309,349 etc. and especially 2-(2'-hydroxy-5'-t-butylphenyl)-benzotriazole, 2-(2'-hydroxy-3',5'-di-t-butylphenyl)benzotriazole, 2-(2'-hydroxy-3'-t-butyl-5'-butylphenyl)-5-chlorobenzotriazole, 2-(2'-hydroxy-3',5'-di-t-butylphenyl)-5-chlorobenzotriazole, and the like. As surface active agents which are used as permiability improving agents of coating aids, emulsifying agents and treatment liquid, antifogants or controllers of several physical characters in light-sensitive materials, anionic, cationic, non-ionic or amphoteric compound can be used which are disclosed in BP 548,532, 1,216,389, U.S. Pat. Nos. 3,026,202, 3,514,293, PP Nos. Sho 44-26580/1969, 43-17922, -17926, -13166/1968, 48-20785/1973 FP 202,588, Bel. P 773,459, PPP No. Sho 48-101118/1973; mordants are such compounds as are disclosed in U.S. Pat. Nos. 2,113,381, 2,548,564 and the like; antistain agents are compounds such as are disclosed in U.S. Pat. Nos. 2,360,210, 2,728,659, 2,732,300, 3,700,453, e.g. 2-methyl-5-hexadecylhydroquinone, 2-methyl-5-sec-octadecylhydroquinone and 2,5-di-t-octylhydroquinone; antistatic agents are such compounds as are disclosed in U.S. Pat. No. 3,573,093, PPP No. Sho 48-89979/1973, U.S. Pat. Nos. 2,882,157, 2,972,535, 3,704,128, PPP Nos. Sho 48-43130, -90391/1973, BP 1,378,584, U.S. Pat. No. 3,573,093 PP Nos. 48-43809/1973, 49-64/1974, 47-8742/1972 and PPP No. Sho 47-33627/1972; matting agents are those such as are disclosed in BP 1,221,980; U.S. Pat. Nos. 2,992,101, 2,956,884, FP 1,395,544 and BP 1,307,373, especially silica gel having 0.5–20$\mu$ in diameter and a polymer of polymethyl acrylate of 0.5–20$\mu$ in diameter; as development accelerators, such compounds as benzylalcohol and polyethyleneoxide may be used and added effectively in a treatment bath.

The light-sensitive silver halide photographic materials according to this invention may be coated on a suitable photographic support in the form of a silver halide emulsion containing the said several photographic additives together with other constitutional layers. The supports used for this invention are baryta paper, paper coated with polyethylene, polypropylene synthetic paper, glass plate, cellulose acetate, cellulose nitrate, polyester film such as polyethylene terephthalate, polyamide film, polypropylene film, polycarbonate film, polystyrene and the like. These supports can be adequately chosen according to the use object of the light-sensitive photographic materials.

The images obtained by this invention have high-contrast silver images, so this invention can be applicable to several fields requiring high-contrast black-white records. The light-sensitive materials used in this invention are preferably applicable to photolithography, micro photography or X-ray photography for industrial use.

The process of this invention, especially as a image forming method for photolithography, has excellent characteristics that has not been attained by a conventional method.

The mechanisms of the process for performance of high-contrast silver images according to this invention are not necessarily clear, but it is thought that hydroquinones in developers were oxidized by non-diffusible oxidants, so that semiquinones are accumulated near the developed silver part at a extremely high concentration. Generally speaking, in case where the sulfite ion is present at a high concentration, these semiquinones or quinones are at once sulfonated and removed so that the so-called infectious development is thought not to occur. But in the process of this invention, it is presumed that the supply of semiquinones are superior to removal so that the infectious development just occurs at the place of the silver halide exposed in gelatin matrix. Therefore, in this invention it is essential to treat the silver halide materials with a developer containing a hydroquinone type developing agent. But this developer is a hydroquinone type developer but not necessary to be the so-called lith type developer (infectious developer). It is sufficient to form lith type high-contrast silver images in the presence of a high concentration of a sulfurous acid ion. This process is quite different from known processes in that it is not necessary to use hydroquinones, alkali and alkali bromide, and a sulfurous acid ion in a low concentration and preservatives such as formaldehyde sodium bisulfite and a carbonyl ammonium bisulfite adduct, as in the conventional lith type developer (the use of these compounds is of course possible).

The hydroquinone developing agents used for this invention are hydroquinone, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 2,5-dihydroxyacetophenone, 2,5-diethylhydroquinone, 2,5-di-phenethylhydroquinone, 2,5-dibenzoylaminohydroquinone and the like. In the developer containing hydroquinone type developing agents of this invention, there is involved not only the so-called lith type developer but also a gradational metol-hydroquinone (MQ) developer or phenidon-hydroquinone developer (PQ), and particularly MQ or PQ developer is preferably applicable to this invention from the viewpoint of the excellent preservability of the solution. Developers having super additivity are especially preferred, and such developers or developing aids as are described in The Theory of Photographic Process (3rd Ed. 374–378 (1966)) can be advantageously used. As preservatives used for this invention, there can be used a sulfite such as sodium sulfite, potassium sulfite and ammonium sulfite without impairing the effect of this invention. This is one of the distinguishing features of this invention. It is also optional to control the pH value of the developer and let it have buffer function by adding alkali hydroxides, alkali carbonates or amines which are used in ordinary black-white developers. It is optional to add an inorganic development inhibitor such as potassium bromide and an organic development inhibitor such as benzotriazole.

In this invention, "processing the light-sensitive silver halide photographic materials with a developer containing hydroquinone developing agents" means developing the light-sensitive photographic materials of this invention in the developing solution which at least contains hydroquinone. So various modifications are possible: for example temperature of the solution is preferably below 50° C. and particularly near 30° C.; the developing time is generally within 30 minutes, and particularly preferable within 5 minutes; treatments after development such as water washing, stopping, stabilization, and fixing, and further prehardening and neutralization may be optionally applicable and these treatments can be omitted according to circumstances. These treatments may be carried out by means of manual developments such as bath development and frame development or by means of mechanical developments such as roller development and hanger development. According to one preferred embodiment of this invention, the stability of the treatment liquid in the case of a bath development is 20 times better than that of known lith developers. Particularly in the case of use of a known lith type developer (infectious developer), in which the sulfite ion is extremely decreased, in order to maintain good dot qualities, the life time of the solution is only for about several hours. On the contrary, the solution according to a preferred embodiment of this invention can be used safely and exerts excellent dot qualities equal to those newly prepared even after the lapse of above one month. Further addition of additives such as contrast controlling agents which are usually used in conventional high-contrast developers, does not cause any bad effect on an photographic image produced using the present invention.

This invention is illustrated hereinafter by references, typical preparative examples and examples but such examples are not meant to limit the scope of this invention and several modification thereof may be possible.

REFERENCE-1

The following samples were prepared:

SAMPLE A

Sample A was prepared by coating a photographic support with a gelatin aqueous solution so as to have 200 mg of the coated amount per 100 $cm^2$.

SAMPLE B

Sample B was prepared in the same way as in A, using a gelatin solution prepared by adding to the above gelatin solution an ion pair consisting of 2,3,5-triphenyltetrazolium chloride (hereinafter, referred to as T-Salt) and DES so as to have 30 mg calculated in terms of T-Salt per 100 $cm^2$.

The gelatin films of both Samples A and B were hardened with formaldehyde.

On the other hand, to a buffer solution having pH 7.0 (ionic strength: 0.1) consisting of potassium dihydrogen phosphate and sodium hydroxide was dissolved in $1.0\times10^{-3}$ mol/l of hydroquinone and this solution was added on the surface of samples A and B in as small an amount as possible. The surface oxidation-reduction potentials of samples A and B were measured using a platinum electrode and saturated calomel electrodes as comparative electrode. The results were listed in Table 1.

Table 1

| Sample | (at 25° C.) Surface oxidation-reduction Potential |
|---|---|
| A | 282 mV |
| B | 340 mV |

It is evident from Table 1 that hydroquinones was oxidized with the substantially non-diffusible oxidant.

REFERENCE-2

The sample was prepared by coating a gelatin aqueous solution containing an ion pair consisting of T-Salt and DES prepared according to preparative example-1 on a polyethylene phthalate support so as to cover 50 mg of gelatin/100 $cm^2$ and about 2.0 mg of the ion pair of T-Salt and DES/100 $cm^2$ calculated in terms of T-Salt and then drying.

Then, the diffusibility of this ion pair in a developer was examined by quantitatively measuring the remaining ion pair amount after the above sample was immersed into a developer having the following composition at 30° C. for 10 minutes:

| Developer composition | |
|---|---|
| Metol | 3.5 g |
| Anhydrous sodium sulfite | 60 g |
| Hydroquinone | 9.0 g |
| Sodium carbonate monohydrate | 54.0 g |
| Potassium bromide | 2.5 g |
| 5-Nitrobenzoimidazole | 0.5 g |
| 1-phenyl-5-mercaptotetrazole | 10 mg |
| Water to make | 1000 ml |
| pH = 10.25 | |

The ion pair amount of T-Salt and DES remaining in the sample was measured quantitatively as an amount of T-Salt as follows:

The gelatin of 10 cm×10 cm in the sample was decomposed with a 0.1% pronase solution and sodium sulfide was added to this solution to reduce the T-Salt to formazan dye which was completely extracted with chloroform. The chloroform solution containing this formazan dye was measured colorimetrically using 480nm wave length.

The results were listed in Table 2 for comparison.

Table 2

| Sample | An amount of T-Salt mg/100 $cm^2$ |
|---|---|
| The untreated sample | 2.03 |
| The sample immersed into the developer | 2.00 |

Then, the decreasing rate of T-Salt in the treated sample was calculated by the following equation:

$$\text{Decreasing rate} = \frac{[\text{T-Salt amount in the untreated sample}]}{[\text{T-Salt amount in the untreated}} - \frac{[\text{T-Salt amount in the treated sample}]}{\text{sample}]} \times 100$$

$$= \frac{2.03 - 2.00}{2.03} \times 100 = 1.48[\%]$$

This result showed clearly that the ion pair of T-Salt and DES according to this invention was not dissolved out in the treatment liquid during development and was a substantially non-diffusible compound.

Next, typical preparative examples of substantially non-diffusible compounds applicable preferably to this invention will be illustrated as follows.

PREPARATIVE EXAMPLE-1

To 100 ml of a 10% gelatin solution at 40° C. was added 10 ml of a 10% T-Salt solution. To this solution was added with vigorous stirring 20 ml of a 10% DES solution. This mixture was cooled, setted and formed in noodles and washed with water until the chlorine ion could not be detected and finished in 250 ml.

PREPARATIVE EXAMPLE-2

To 100 ml of a 10% gelatin solution at 40° C. was added 10 mg of a 10% $[Co(NH_3)_6]Cl_3$ solution. To this solution was added with vigorous stirring 60 mg of a 10% solution of soium didodecylsuccinatesulfonate. The dispersed mixture, as in preparative example-1, was cooled, settled and formed in noodles and washed with water and then finished in 250 ml.

PREPARATIVE EXAMPLE-3

The following desired ion pairs were prepared in the same way as in preparative example-1, except that the compounds listed in A column in Table 3 were used instead of 2,3,5-triphenyltetrazolium chloride in preparative example-1 and the compounds listed in B column in Table 3 were used instead of diethylhexylsuccinate sodium sulfonate in preparative example-2.

Table 3

| Preparative example | A | B |
|---|---|---|
| 3-a | 2,3-diphenyl-5-methyl-2H-tetrazolium chloride | Sodium diisopropyl-naphthalenedisulfonate |
| 3-b | 3-(p-hydroxyphenyl)-5-methyl-2-phenyl-2H-tetrazolium chloride | sodium stearate |
| 3-c | 2,3-diphenyl-5-nitro-2H-tetrazolium chloride | sodium polyacrylate |
| 3-d | 2,5-diphenyl-3-(p-tolyl)-2H-tetrazolium chloride | sodium p-dodecylbenzene-sulfonate |

COMPARATIVE EXAMPLE-1

A silver chloro-bromo-iodide in a fine particle gelatin emulsion containing 90 moles % of chloride, 9 moles % of bromide and 1 mole % of iodide was chemically sensitized using sulfur and gold sensitizers. To this emulsion was added an oleinic acid ether of polyethylene glycol (molecular weight=1540) in a ratio of 200 mg per 1 mole of silver. This emulsion was then coated on a polyethylene terephthalate support so as to cover 55 mg of silver/100 $cm^2$ and 50 mg of coated gelatin/100 $cm^2$. Further, on this silver halide emulsion layer was coated gelatin in an amount of 30 mg/100 $cm^2$ as a protective layer. This photographic element was wedge-exposed through a halftone screen with a halftone with tungsten lamp and treated as follows (the treatment temperature: 30° C.)

| | | |
|---|---|---|
| Development | 1.30 | minutes |
| Water washing | 1.0 | minutes |
| Fixing | 2 | minutes |
| Water washing | 5 | minutes |
| Drying | | |

The treating baths were composed of the following composition:

| | | |
|---|---|---|
| Developer composition | | |
| Metol | 3.5 | g |
| Anhydrous sodium sulfite | 60 | g |
| Hydroquinone | 9.0 | g |
| Sodium carbonate monohydrate | 54 | g |
| Potassium bromide | 2.5 | g |
| 5-Nitrobenzoimidazole | 0.5 | g |
| 1-phenyl-5-mercaptotetrazole | 10 | mg |
| Water to make | 1000 | ml |
| pH = 10.25 | | |
| Fixing solution | | |
| Ammonium thiosulfate 10 hydrates | 150 | g |
| Anhydrous sodium sulfite | 10 | g |
| Anhydrous disodium hydrogen phosphate | 15 | g |
| Water to make | 1000 | ml |
| pH = 6.80 | | |

COMPARATIVE EXAMPLE-2

This example was duplicated as in comparative example-1 except that T-Salt was added to the emulsion in an amount of 4 g per one mole of silver before coating.

EXAMPLE-1

The sensitive material was prepared in the same way as in comparative example-1 except that an ion pair of T-Salt and DES was added to the emulsion in an amount of 8 g per one mole of silver instead of T-Salt used in comparative example-2.

EXAMPLE-2

The sensitive material was prepared in the same way as in comparative example-1 except that an ion pair of 3-diphenyl-5-methyl-2H-tetrazolium chloride and sodium dipropylnaphthalenedisulfonate was added to the emulsion in an amount of 8 g per one mole of silver instead of T-Salt used in comparative example-2.

EXAMPLE-3

The sensitive material was prepared in the same way as in comparative example-1 except that an ion pair of 2,3-diphenyl-5-nitro-2H-tetrazolium chloride and polyacrylic acid was added to the emulsion in an amount of 8 g per one mole of silver instead of T-Salt used in comparative example-2.

The results of comparative example 1–2 to examples 1–3 were listed in Table 4.

Table 4

| Photographic performance Sample | Relative sensitivity | Γ | Fog | Dot quality |
|---|---|---|---|---|
| Comparative example-1 | 100 | 9.70 | 0.04 | 2.5 |
| Comparative example-2 | extremely desensitized | 11.72 | 0.10 | 3.0 |

Table 4-continued

| Photographic performance Sample | Relative sensitivity | Γ | Fog | Dot quality |
|---|---|---|---|---|
| Example-1 | 85 | 12.35 | 0.04 | 4.5 |
| Example-2 | 82 | 11.87 | 0.04 | 4.0 |
| Example-3 | 78 | 12.15 | 0.04 | 4.0 |

It is evident from Table 4 that the light-sensitive silver halide materials containing substantially non-diffusible compounds having oxidation power on hydroquinone developing agents according to this invention improved contrast considerably without causing remarkable desensitization. Further, even in the case of being processed using a metol-hydroquinone developer, the material showed excellent dot quality and excellent characteristics as a lith type sensitive material. "Dot quality" here in the examples of this invention means visually estimated value of reproduced halftone dot images. Halftone images obtained from the exposed and then developed lithographic light-sensitive photographic material are composed of the part called generally "shadow dot" and the part known as "highlight part". "Dot quality" here means an estimated value of the dot in the part having 50% dot in which a half of a definite area is clear and the rest of it is a developed image and the dot quality is expressed in a progressive scale. That is, "4" means excellence and "1" extremely poor. Dot quality below 3 can not be permitted generally.

COMPARATIVE EXAMPLE-3

This example was prepared in the same way as in comparative example-1 except that, before coating, a gelatin containing 4 g of T-Salt per 1 mole of silver was coated on a polyethylene terephthalate support in an amount of 40 mg of coated gelatin/100 $cm^2$. The results are shown in Table 5.

EXAMPLE-4

This example was prepared in the same way as in comparative example-3 except that an ion pair of 2,3-diphenyl-5-nitro-2H-tetrazolium chloride and sodium acrylate was added in an amount of 6 g per mole of silver instead of T-Salt used in comparative example-3. The results are shown in Table 5.

EXAMPLE-5

This example was prepared in the same way as in comparative example-3, except that an ion pair of 2,3-diphenyl-5-nitro-2H-tetrazolium chloride and sodium p-dodecylbenzenesulfonate was added in an amount of 8 g per mole of silver instead of T-Salt used in comparative example-3. The results were shown in Table 5.

Table 5

| Photographic performance Sample | Relative sensitivity | Γ | Fog | Dot quality |
|---|---|---|---|---|
| Comparative example-1 | 100 | 9.70 | 0.04 | 2.5 |
| Comparative example-3 | 68 | 11.87 | 0.08 | 3.5 |
| Example-4 | 93 | 12.42 | 0.04 | 4.5 |
| Example-5 | 90 | 12.38 | 0.04 | 4.5 |

It is evident from this Table that the light-sensitive silver halide materials of this invention were extremely high in control and had excellent dot characteristics and excellent qualities for the light-sensitive photographic material for photolithography.

COMPARATIVE EXAMPLE-4

This example was prepared in the same way as in comparative example-1, except that it was treated by the following treatment conditions instead of those in comparative example-1.

| | |
|---|---|
| Development-sodium bisulfite adduct | 50 g |
| Hydroquinone | 15 g |
| Boric acid | 8 g |
| Anhydrous sodium sulfite | 20 g |
| Sodium carbonate monohydrate | 85 g |
| Potassium bromide | 2.5 g |
| 6-nitroimidazole | 0.1 g |
| Water to make | 1000 ml |
| pH = 10.00 | |
| Treatment (at 30° C.) | |
| Development | 10 minutes |
| Water washing | 1 minutes |
| Fixing | 2 minutes |
| Water washing | 5 minutes |
| Drying | |

The results are listed in Table 6

COMPARATIVE EXAMPLE-5

This example was prepared in the same way as in comparative example-4, except that $[Co(III)(NH_3)_6]Cl_3$ was added to the emulsion in an amount of 3 g per mole of silver before coating.

EXAMPLE-6

This example was prepared in the same way as in comparative example-5, except that a gelatin containing an ion pair of $[Co(III)(NH_3)_6]Cl_3$ and DES in an amount of 8 g per mole of silver was coated in an amount of 40 mg/100 $cm^2$ of coated gelatin.

The results are listed in Table 6

Table 6

| Photographic performance Sample | Relative sensitivity | Γ | Fog | Dot quality |
|---|---|---|---|---|
| Comparative | 100 | 11.26 | 0.04 | 2.5 |
| Comparative | extremely desensitized | 12.13 | 0.04 | 3.0 |
| Example-6 | 99 | 12.62 | 0.04 | 4.0 |

It is evident from this Table that the sample of this invention had excellent character as high-contrast light-sensitive materials.

COMPARATIVE EXAMPLE-6

A gelatin emulsion containing silver iodo-bromide in fine particles having [100] surface in composition of 98% mole bromide and 2% mole iodide was chemically sensitized with sulfur and gold sensitizers. This gelatin was then coated on a polyethylene terephthalate in an amount of 30 mg/100 $cm^2$ of silver and 40 mg/100 $cm^2$ of gelatin, and gelatin was further coated on it in an amount of 30 mg/100 $cm^2$ as a protective layer. This sensitive material was wedge-exposed with tungstic light and treated as follows at 30° C.

| | |
|---|---|
| Development | 2 minutes |
| Water washing | 1 minutes |
| Fixing | 2 minutes |
| Water washing | 5 minutes |

-continued

| Drying |
|---|

The treatment bath has the following composition:

| Development composition | |
|---|---|
| Metol | 1.0 g |
| Anhydrous sodium sulfite | 75.0 g |
| Hydroquinone | 9.0 g |
| Sodium carbonate monohydrate | 29.0 g |
| Potassium bromide | 4.0 g |
| Water to make | 1000 ml |
| pH = 10.00 | |

The same fixing solution as in Example-1 was used. The results are shown in Table 7.

COMPARATIVE EXAMPLE-7

This example was prepared in the same way as in comparative, except that a gelatin layer containing T-Salt in an amount of 4 g per mole of silver was coated in advance on a polyethylene terephthalate in an amount of 40 mg/100 $cm^2$ of gelatin. The results are shown in Table 7.

EXAMPLE-7

This example was prepared in the same way as in comparative example-7, except that a gelatin layer containing an ion pair of T-Salt and DES in an amount of 4 g per mole of silver was coated in an amount of 40 mg/100 $cm^2$ of gelatin instead of T-Salt in comparative example-7.

The results are shown in Table 7.

Table 7

| Sample | Photographic performance Relative sensitivity | Γ | Fog | Resolving power* |
|---|---|---|---|---|
| Comparative example-6 | 100 | 2.42 | 0.04 | 200 lines/mm |
| Comparative example-7 | extremely desensitized | 2.58 | 0.12 | 250 |
| Example-7 | 84 | 2.54 | 0.04 | 300 |

*The resolving power was measured by Koana's measurement

It is evident from Table 7 that the light-sensitive materials according to this invention had excellent characteristics as high-contrast light-sensitive silver halide materials.

EXAMPLE-8

0.5 g of 2,2',3,3'-tetraphenyl-5,5'-p-phenylene-di-(2H-tetrazolium)chloride was dissolved in 3.0 g of fluorinated alcohol (manufactured by Daikin Kogyo Co., Ltd.) and 0.5 g of tricresyl phosphate and mixed with a gelatin solution in Alkanol x C (manufactured by E.I. Du pont).

This solution was protect-dispersed with a ultrasonic dispersing machine. This dispersed solution was added to an industrial X-ray emulsion containing silver iodobromide in 0.5–0.7μ of silver diameter. This emulsion was coated on both surfaces of a polyester resin support of which both surfaces were under-coated in an amount of 120 mg/100 $cm^2$ of silver and 4 mg/$100^2$ of the tetrazolium salt per surface, thus obtaining sample 1. This sample was exposed with non-screen as in a usual industrial X-ray film and developed with an automatic developing machine (IX-17 manufactured by Konishiroku Photo Industry Co., Ltd.) Sample 2 was prepared and developed in the same way as in sample 1 except that the tetrazolium salt was not included. These results are shown in Table 8.

The following developer was used in particular.

| Developer composition | |
|---|---|
| Water | 500 ml |
| Hydroxyethylethylenediamine acetate | 1.5 g |
| Anhydrous sodium sulfite | 50 g |
| Potassium hydroxide | 16.0 g |
| Hydroquinone | 25.0 g |
| 1-phenyl-3-pyrazolidone | 0.8 g |
| Potassium carbonate | 13.0 g |
| Diethyleneglycol | 12.0 g |
| Triethyleneglycol | 24.0 g |
| Glutaraldehyde | 5.0 g |
| Potassium bromide | 6.0 g |
| Sodium bisulfite | 8.0 g |
| Glacial acetic acid | 4.7 g |
| 5-Nitroimidazole | 0.07 g |
| 1-phenyl-5-mercaptotetrazole | 0.01 g |
| Water to make | 1000 ml |
| pH = about 10.20 | |

Table 8

| Photographic performance Sample | Γ in straight part | Relative sensitivity | Maximum density | Minimum density |
|---|---|---|---|---|
| I | 4.1 | 91 | above 4.0 | 0.02 |
| II (outside of this invention) | 2.7 | 100 | " | 0.04 |

It is evident from Table 8 that the sample of this invention was high in γ in the straight part and low in the minimum density and that the method according to this invention is was extremely excellent in forming a high-contrast image.

What is claimed is:

1. A method of forming a high-contrast black and white silver image by use of a light-sensitive silver halide photographic material having a support and a hydrophilic colloidal layer thereon which method comprises imagewise exposing said photographic material to light and processing said exposed photographic material by a developer having superadditivity and a pH value of 8.5 to 12.5 and containing hydroquinone-metol or hydroquinone-phenidone, said photographic material containing at least one substantially non-diffusible compound capable of oxidizing hydrquinone, said substantially non-diffusible compound being selected from the group consisting of: N-chloro-p-dodecylbenzenesulfonamide sodium; N-chloro-p-nonylbenzenesulfonamide sodium; 2-dodecylbenzoquinone, 2,5-dioctylbenzoquinone; 2-dodecyl-5-methylbenzoquinone; 2-(benzothiazol-2-yl)-3-phenyl-5-dodecyl-2H-tetrazolium bromide; 2,3-diphenyl-5-(4-t-octyloxyphenyl)-2H-tetrazolium chloride; stearic peracid; palmitic peracid; tetraphenylphosphonium bichromate; tetraphenylphosphonium permanganate; tetraphenylarsonium perchromate; and a salt of an anion and a cation, said anion being selected from the group consisting of: p-dodecylbenzenesulfonic acid anion, lauryl sulfate anion, di-2-ethylhexyl sulfosuccinic acid anion, ethylpolyethenoxy sulfate anion, stearic acid anion, and said cation being selected from the group of a tetrazolium cation, a triazolium cation, 1,1'-dimethyl-4,4'-bipyridinium, 1,1'-diethyl-4,4'-bipyridinium and 1,1'-dibenzyl- 4,4'-bipyridinium.

2. A method of forming a high-contrast black and white silver image as claimed in claim 1 in which said tetrazolium cation is selected from the group consisting of:

2,3,5-triphenyl-2H-tetrazolium,
2,3,5-tri(p-carboxyethylphenyl)-2H-tetrazolium,
2-(benzothiazol-2-yl)-3-phenyl-5-(o-chlorophenyl)-2H-tetrazolium,
2,3-diphenyl-2H-tetrazolium,
2,3-diphenyl-5-methyl-2H-tetrazolium,
3-(p-hydroxyphenyl)-5-methyl-2-phenyl-2H-tetrazolium
2,3-diphenyl-5-ethyl-2H-tetrazolium,
2,3-diphenyl-5-n-hexyl-2H-tetrazolium,
5-cyano-2,3-diphenyl-2H-tetrazolium,
2-(benzothiazol-2-yl)-5-phenyl-3-(4-tolyl)-2H-tetrazolium,
2-(benzothiazol-2-yl)-5-(4-chlorophenyl)-3-(4-nitrophenyl)-2H-tetrazolium,
5-ethoxycarbonyl-2,3-di(3-nitrophenyl)-2H-tetrazolium,
5-acetyl-2,3-di(p-ethoxyphenyl)-2H-tetrazolium,
2,5-diphenyl-3-(p-tolyl)-2H-tetrazolium,
2,5-diphenyl-3-(p-iodophenyl)-2H-tetrazolium,
2,3-diphenyl-5-(p-diphenyl)-2H-tetrazolium,
5-(p-bromophenyl)-2-phenyl-3-(2,4,6-trichlorophenyl)-2H-tetrazolium,
3-(p-hydroxyphenyl)-5-(p-nitrophenyl)-2-phenyl-2H-tetrazolium,
5-(3,4-dimethoxyphenyl)-3-(2-ethoxyphenyl)-2-(4-methoxyphenyl)-2H-tetrazolium,
5-(4-cyanophenyl)-2,3-diphenyl-2H-tetrazolium,
3-(p-acetamidophenyl)-2,5-diphenyl-2H-tetrazolium,
5-acetyl-2,3-diphenyl-2H-tetrazolium,
5-(fur-2-yl)-2,3-diphenyl-2H-tetrazolium,
5-(thien-2-yl)-2,3-diphenyl-2H-tetrazolium,
2,3-diphenyl-5-(pyrid-4-yl)-2H-tetrazolium,
2,3-diphenyl-5-(quinol-2-yl)-2H-tetrazolium,
2,3-diphenyl-5-(benzoxazol-2-yl)-2H-tetrazolium,
2,3-diphenyl-5-nitro-2H-tetrazolium,
2,2',3,3'-tetraphenyl-5,5'-(1,4-butylene)-di-(2GH-tetrazolium),
2,2',3,3'-tetraphenyl-5,5'-p-phenylene-di-(2H-tetrazolium),
2-(4,5-dimethylthiazol-2-yl)-3,5-diphenyl-2H-tetrazolium,
3,5-diphenyl-2-(traizin-2-yl)-2H-tetrazolium, and
2-(benzothiazol-2-yl)-3-(4-methoxyphenyl)-5-phenyl-2H-tetrazolium.

3. A method of forming a high-contrast black and white silver image as claimed in claim 1 in which said triazolium cation is selected from the group consisting of:

1-methyl-2-phenyl-2H-1,2,3-triazolium,
1-n-propyl-2-phenyl-2H-1,2,3-triazolium,
2-(4-methoxyphenyl)-3-phenyl-2H-naphtho-[1,2-d]-1,2,3-triazolium,
1,5-(9,10-anthraquinolyl)-bis{2-[3-phenyl]-2H-naphtho-[1,2-d]-1,2,3-triazolium}, and
2,3-di(4-methoxyphenyl)-5-nitro-2H-naptho[1,2-d]-1,2,3-triazolium.

4. The method of claim 1 in which said salt is selected from the group consisting of 2,3,5-triphenyl-2H-tetrazolium diethylhexylsuccinatesulfonate salt, 2,3,5-triphenyl-2H-tetrazolium isopropylnaphthalenesulfonate salt and 2,3-diphenyl-5-dodecyl-2H-tetrazolium diethylhexylsuccinate-sulfonate salt.

5. The method of claim 1 in which said hydrophilic colloidal layer comprises gelatin.

* * * * *